US008690146B2

(12) United States Patent
Capoia

(10) Patent No.: US 8,690,146 B2
(45) Date of Patent: Apr. 8, 2014

(54) APPARATUS FOR LOADING A RELATIVELY RIGID MATERIAL, FOR EXAMPLE CARDBOARD, AND RELATIVE LOADING METHOD

(75) Inventor: Giuseppe Capoia, Cimadolmo (IT)

(73) Assignee: Panotec SRL, Cimadolmo (IT)

( * ) Notice: Subject to any disclaimer, the term of this patent is extended or adjusted under 35 U.S.C. 154(b) by 470 days.

(21) Appl. No.: 13/063,726

(22) PCT Filed: Sep. 9, 2009

(86) PCT No.: PCT/IB2009/006802

§ 371 (c)(1),
(2), (4) Date: Mar. 11, 2011

(87) PCT Pub. No.: WO2010/029418

PCT Pub. Date: Mar. 18, 2010

(65) Prior Publication Data

US 2011/0164954 A1 Jul. 7, 2011

(30) Foreign Application Priority Data

Sep. 12, 2008 (IT) ..... UD2008A0197

(51) Int. Cl.
*B65H 3/44* (2006.01)
*B65H 7/02* (2006.01)
*B65H 43/00* (2006.01)

(52) U.S. Cl.
USPC ..... 271/9.01; 271/273; 271/265.01; 271/176

(58) Field of Classification Search
USPC ..... 271/9.01, 273, 265.01, 176, 314, 9.12; 198/348, 357, 358
See application file for complete search history.

(56) References Cited

U.S. PATENT DOCUMENTS

| | | | | |
|---|---|---|---|---|
| 5,169,140 | A | 12/1992 | Wenthe | |
| 8,200,103 | B2 * | 6/2012 | Sasaki et al. | 399/16 |
| 2002/0130458 | A1 * | 9/2002 | Okada et al. | 271/9.12 |
| 2002/0153652 | A1 * | 10/2002 | Niiyama et al. | 271/9.01 |
| 2004/0247365 | A1 | 12/2004 | Lofthus et al. | |
| 2004/0256785 | A1 * | 12/2004 | Tunink et al. | 271/9.01 |
| 2005/0082737 | A1 * | 4/2005 | Sasaki et al. | 271/9.12 |
| 2010/0270728 | A1 * | 10/2010 | Hoover et al. | 271/9.01 |

FOREIGN PATENT DOCUMENTS

| | | | |
|---|---|---|---|
| EP | 1577239 | A | 9/2005 |
| WO | 2006091558 | A | 8/2006 |

OTHER PUBLICATIONS

International Search Report and Written Opinion for PCT Application PCT/IB2009/006802, European Patent Office, Jun. 4, 2010.

* cited by examiner

*Primary Examiner* — David H Bollinger
(74) *Attorney, Agent, or Firm* — Mannava & Kang, P.C.

(57) ABSTRACT

An apparatus for loading a relatively rigid material in sheets into an operating station of a processing plant, comprises at least a store for storing and feeding the sheets and a loading device. The loading device is provided at least with feed means, disposed downstream of the store with respect to the direction of feed of the sheets, and able to feed the sheets into the operating station. The apparatus also comprises detection means, disposed in correspondence with the feed means, able to detect both the position of the sheets with respect to the feed means, and also the size of the sheets fed. The detection means are also able to vary in a coordinated manner the operating conditions at least of the feed means according to the position and sizes detected.

10 Claims, 2 Drawing Sheets fig. 2

APPARATUS FOR LOADING A RELATIVELY RIGID MATERIAL, FOR EXAMPLE CARDBOARD, AND RELATIVE LOADING METHOD

PRIORITY

The present application claims priority under 35 U.S.C. §371 to PCT Application PCT/IB2009/006802, filed on Sep. 9, 2009, which claims priority to Italian Patent Application No. UD2008A000197, filed on Sep. 12, 2008, the disclosures of which are hereby incorporated by reference in their entireties.

FIELD OF THE INVENTION

The present invention concerns an apparatus for loading a relatively rigid material, for example cardboard, in a processing plant. In particular the present invention can be used, advantageously but not restrictedly, for the loading of cardboard, in the form of strips, or sheets, on operating stations, for example creasing stations. Here and in the following description and claims, by the term sheets we mean, generically, both pre-cut single sheets and also sheets from rolls or strip.

The invention also concerns the relative method for loading such material.

BACKGROUND OF THE INVENTION

In the packing or packaging sector, plants used to carry out a plurality of processes on a packaging material, such as a sheet of cardboard, are known.

Such plants comprise one or more operating stations provided with tools, for example creasing or cutting tools, or other, of an adjustable type.

Upstream of the operating stations, with respect to the direction of feed of the sheet, this type of plant provides a loading apparatus which comprises a storage and feed store, in which at least a pallet of sheets of packaging material is disposed, means to pick up and transport the material from the store, and a device for loading the material into the operating stations.

In particular, known loading devices comprise a single feed roll, which extends along the width of the device and moves the strip forward toward the operating stations and one or more trays, each of an adjustable width, and able to guide the sheet in a precise and predefined way, toward the feed roll.

The adjustment of the width of the tray and of the position of the tools has to be carried out on each occasion in the case of a change in the format size of the sheet, thus entailing long preliminary equipping times.

The adjustment operations are long and laborious and require the stations to be stopped.

Moreover, the storing of the material in the store needs a predetermined positioning of the pallet, so that the material, when it is picked up by the pick-up and transport means, is specifically centered and aligned with the tray and with the tools.

This type of known loading apparatuses, having long preliminary equipping times, are mainly applied in productions of dimensionally predefined series of sheets, in a high and repetitive number.

There is an ever-growing need in the market to process series of sheets that are limited in number and very varied in size.

The known loading apparatuses, having long preliminary equipping times to pass from one dimensional series to another, are not used in the production of small series with different dimensions.

Machines are also known which comprise a store divided into a plurality of sectors, each of which contains a specific pallet of sheets of a determinate size.

In this known solution, a plurality of trays are provided, each fed by a corresponding sector, and selectively moved to carry the relative sheet to the feed roll.

In this solution too it is necessary to position the pallets, each in the relative sector, in a predetermined position of specific centering and alignment with the trays. Moreover, all the sectors are sized according to the widest sheet to be processed even if they contain a sheet which is decidedly smaller, and are thus, for the most part, over-sized.

Purpose of the present invention is to make an apparatus and perfect a method for loading a relatively rigid material, which allows to load in sequence series of sheets, even of a limited number, having different dimensions with respect to each other and that allows to reduce the equipping time and to optimize the use of the storage spaces.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the invention or variants to the main inventive idea.

In accordance with the above purposes, a loading apparatus according to the present invention is applied for loading a relatively rigid material in sheets into an operating station of a processing plant.

The apparatus according to the invention comprises at least a storage and feed store for the sheets of relatively rigid material and a loading device, provided with at least feed means, disposed downstream of the store with respect to the direction of feed of the sheets, and able to feed the sheets disposed in the store inside the operating station.

According to a characteristic feature of the present invention, the apparatus comprises detection means disposed in correspondence with the feed means, and able to detect both the position of the sheets with respect to the feed means, and also the size of the sheets fed, and to vary in a coordinated manner the operating conditions at least of the feed means depending on the position and the dimensions detected of the sheets.

With the present invention therefore, the operating conditions, that is, the equipping at least of the feed means, are varied depending on both the position and also the dimensions of the sheet; it is thus possible to feed into the operating station sheets of any dimensions and disposed substantially in any position with respect to the feed means.

This ample possibility of varying the feed conditions of the sheets allows to produce numerically limited series of sheets of different dimensions with respect to each other.

In this way, a plurality of groups, or pallets, of sheets of different dimensions can be disposed in the store, reciprocally positioned adjacent in order to optimize their distribution inside the store, without needing to predefine their specific positioning of centering and alignment with the feed means.

It is therefore possible, given the same space occupied by the store, to load a greater number of pallets of sheets, thus reducing the frequency of supplying and substituting the sheets in the store.

In fact, according to the present invention it is the feed means that operatively adjusts to the dimensions and the position of the sheets coming from the store and not as in the state of the art, where it is the sheets that must be specifically positioned depending on the feed means.

According to a variant, the feed means comprises at least a plurality of feed members, for example rolls, operatively independent with respect to each other and disposed aligned along a direction transverse to the direction of feed of the sheets.

According to this variant, depending on the position and the dimensions detected of the sheets, one or more feed members is selectively fed, so as to divide into sectors the feed of the sheets, using only the feed members needed.

This solution also allows to load several sheets of different sizes in parallel, even at different speeds.

According to a variant, the loading device comprises one or more suitable guide members of a substantially universal size and able to guide the sheets coming from the store toward the feed members.

According to another variant, the detection means comprises at least a sensor member, sliding transversely to the direction of feed of the sheets, and able to detect the position and dimensions of the sheets.

According to another variant, the detection means comprises at least a command and control unit, electronically connected to the sensor member and to said feed means, and able to process the data of position and size, detected by the sensor member, in order to vary the operating conditions of the feed means and allow the feed of any sheet from any position.

According to another variant, the store is divided into two or more sectors inside which pallets of sheets of different sizes are positioned. This variant renders the apparatus extremely versatile, providing in sequence productions that are very varied in size even if they are numerically limited, for each size.

BRIEF DESCRIPTION OF THE DRAWINGS

These and other characteristics of the present invention will become apparent from the following description of a preferential form of embodiment, given as a non-restrictive example with reference to the attached drawings wherein.

DETAILED DESCRIPTION OF A PREFERENTIAL FORM OF EMBODIMENT

Figure 1:
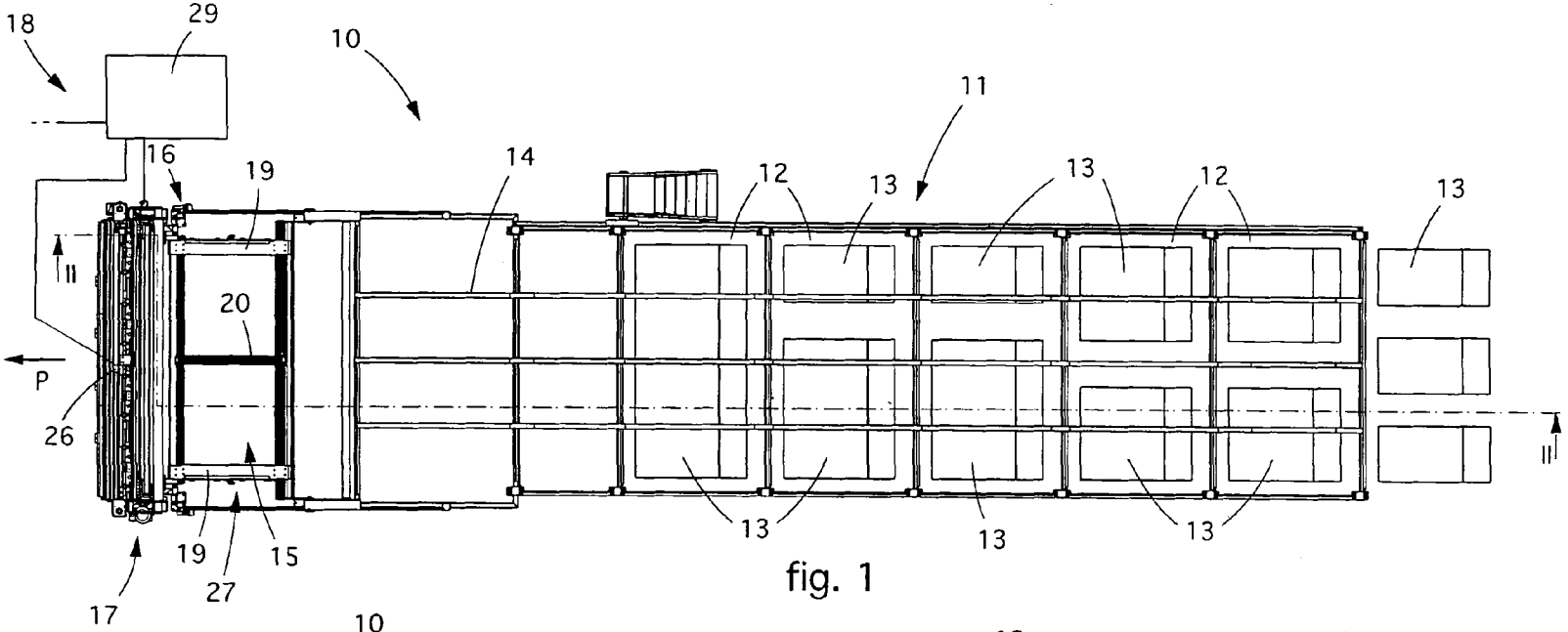
FIG. 1 is a plan view of a loading apparatus according to the present invention.
Figure 2:
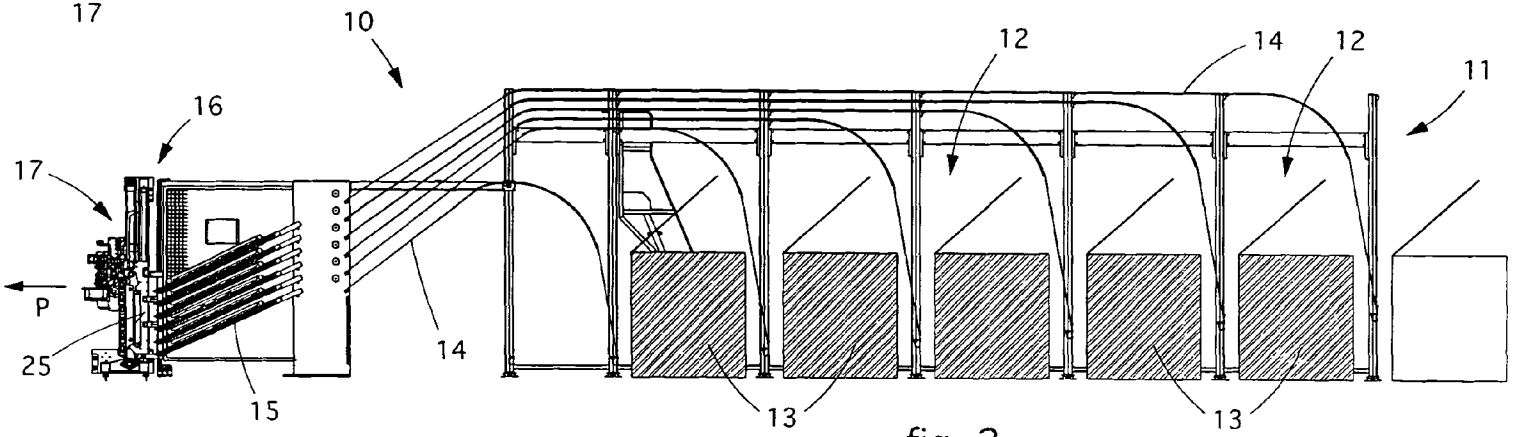
FIG. 2 is a section from II to II of the apparatus in FIG. 1.
Figure 3:
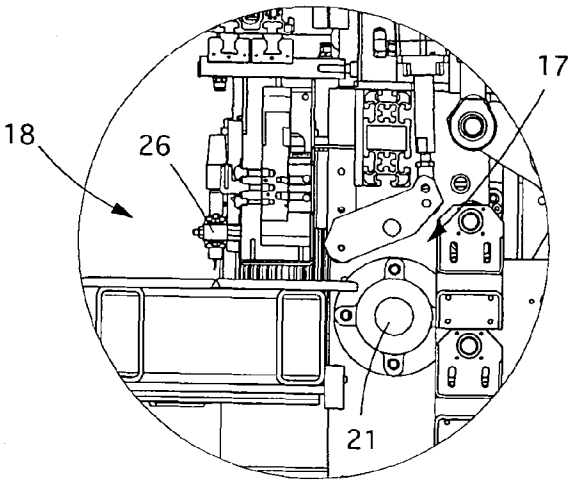
FIG. 3 is an enlarged detail of the apparatus in FIG. 1.

With reference to the attached drawings, an apparatus 10 according to the present invention is used for loading a relatively rigid material, for example cardboard, in the form of a sheet, into a relative operating station, not illustrated, for example a creasing or cutting station or other.

The apparatus 10 comprises a store 11 for storing and feeding the sheets, a device 16 for loading the sheets and detection means 18.

The store 11 is divided into a plurality of sectors 12, in this case five, disposed transverse to the direction of the feed "P" of the sheets.

One or more pallets 13 of sheets of different sizes are positioned in each sector 12, possibly adjacent to each other so as to fill the internal space of the relative sector 12. The loading device 16 comprises pick-up and moving means 14 conformed to pick up the sheets from the store and transport them toward the operating station.

In this case, a plurality of pick-up and moving means 14 are provided, each operatively associated to a relative sector 12, to pick up a sheet from one of the pallets 13.

Advantageously, the pick-up and moving means 14 are conformed on several vertical levels, so that a sector 12 corresponds to each level and so that the simultaneous pick-up from several levels does not cause interference between the sheets. According to a variant, the pick-up and moving means 14 comprise one or more guides, along which the sheets are moved manually.

According to another variant, the pick-up and moving means 14 comprise moving belts which move the sheets in an automatic way.

According to another variant, the pick-up and moving means 14 comprise a conveyor belt which moves the sheets in an automatic way and is equipped with hooks to keep the sheets in a fixed position with respect to the strip.

The loading device 16 comprises feed means 17, disposed downstream of the pick-up and moving means 14, and able to feed the sheets into the operating station.

The loading device 16 also comprises guide members 27, interposed between the pick-up and moving means 14 and the feed means 17, and able to guide the sheets toward the feed means 17.

In this case, the guide members 27 provide a plurality of trays 15, disposed on top of each other and vertically movable by means of a lifting device 25, so that each tray 15 can be carried to the level of the feed means 17.

Each tray 15 comprises two fixed lateral shoulders 19 and a central oblong member 20 and cooperates with a relative pick-up and moving mean 14 to carry the sheet fed from the latter into cooperation with the feed means 17.

Figure 4:
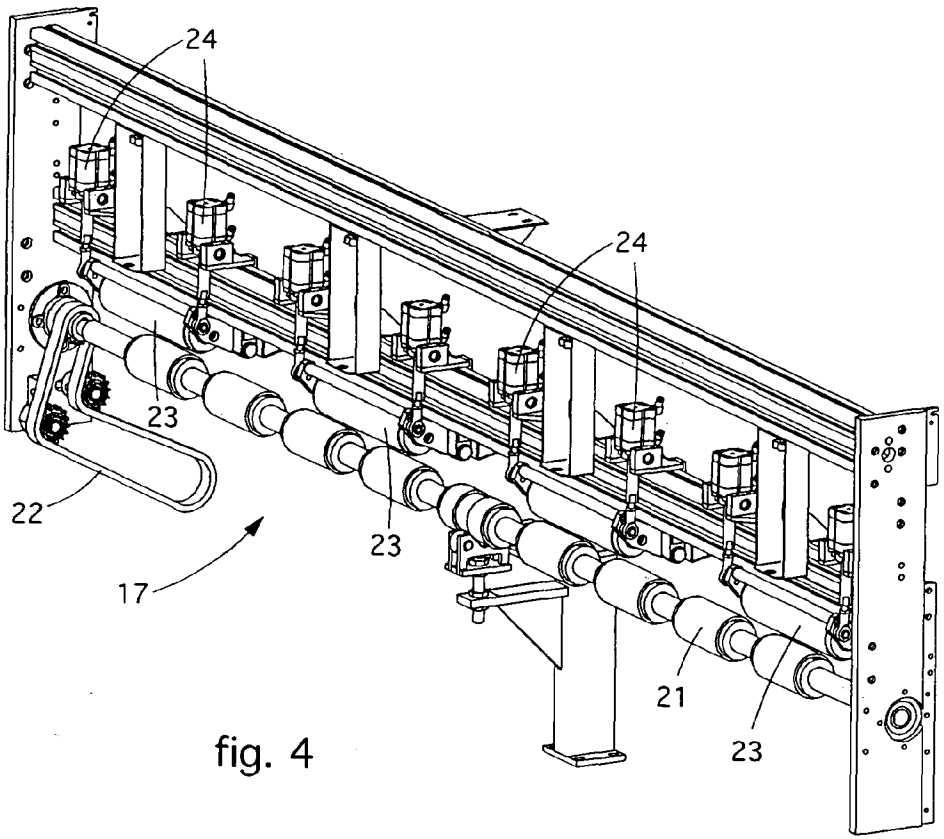
FIG. 4 is a three-dimensional view of a detail of the apparatus in FIG. 1.

With particular reference to FIG. 4, the feed means 17 comprises a plurality of rolls 21, disposed transverse to the direction of feed P of the sheet. The rolls 21 cooperate selectively with a plurality of contrasting rolls 23, in this case four, normally raised with respect to the rolls 21, and able to be selectively moved in an independent way, by means of relative pairs of pistons 24, to bring them into cooperation with the rolls 21 in order to feed the sheets. In this case, the rolls 21 are moved by a motor member, of a known type and not shown here, kinematically connected to the rolls 21, by means of a transmission chain 22.

The detection means 18 comprises an optic sensor 26, mounted immediately downstream of the rolls 21 and the contrasting rolls 23, and mobile transverse to the direction of feed P of the sheet.

The optic sensor 26, during its transverse movement, detects both the position of the sheet with respect to the rolls 21 and 23, and also the lateral size of the sheet itself.

The detection means 18 also comprises a command and control unit 29, electronically connected to the optic sensor 26 and to the pair of pistons 24.

The command and control unit 29 is able to process the data detected by the optic sensor 26 and to command the activation of one or more pairs of pistons 24, depending on the position and the size of the sheet detected.

The activation of one or more pairs of pistons 24 determines the movement downward of the respective contrasting rolls 23. In this way the contrasting rolls 23 move into cooperation with the rolls 21, gripping on the sheet or sheets so as to feed it/them toward the operating station.

According to a variant, the rolls 21 can also be commanded in an independent way with respect to each other. This solution allows to feed forward several sheets in parallel at different speeds, depending on the needs of production.

According to another variant, the command and control unit is also connected to the members that move the tools of the operating station. In this way, in relation to the data supplied by the optic sensor 26, the adjustment of the positioning and orienting of the tools of the operating station is also commanded.

It is clear that modifications and/or additions of parts may be made to the apparatus 10 as described heretofore, without departing from the field and scope of the present invention.

It is also clear that, although the present invention has been described with reference to a specific example, a person of skill in the art shall certainly be able to achieve many other equivalent forms of apparatus for loading a relatively rigid material, having the characteristics as set forth in the claims and hence all coming within the field of protection defined thereby.

The invention claimed is:

1. An apparatus for loading a material, in sheets into an operating station of a processing plant, comprising at least one store for storing and feeding the sheets and a loading device, which is provided at least with feed means, disposed downstream of the at least one store with respect to a direction of feed of the sheets, the loading device feeding the sheets into the operating station, the apparatus comprising detection means, which are disposed in correspondence with the feed means, the detection means for detecting both a position of the sheets with respect to the feed means and a size of the sheets fed, and varying in a coordinated manner operating conditions at least of the feed means according to the position and size detected, wherein the feed means comprises a plurality of feed members, which are operationally independent of each other and disposed aligned along a direction transverse to the direction of feed of the sheets, the plurality of feed members are selectively activated in order to be operatively adjusted to the size and the position of the sheets.

2. The apparatus as in claim 1 wherein the loading device comprises one or more suitable guide members.

3. The apparatus as in claim 1, wherein the detection means comprises at least a sensor member, which is able to slide transversely to the direction of feed of the sheets.

4. The apparatus as in claim 3, wherein the detection means comprises at least a command and control unit, which is electronically connected to the sensor member and to the feed means.

5. The apparatus as in claim 4, wherein the command and control unit is electronically connected to tools of the operating station.

6. The apparatus as in claim 1, wherein the at least one store is divided into two or more sectors inside which pallets of sheets of different sizes are positioned.

7. The apparatus as in claim 1, wherein the material is cardboard.

8. A method for loading a material in sheets into an operating station of a processing plant, comprising at least a first feed step in which, by means of a loading device, provided at least with feed means, disposed downstream of at least one store for storing and feeding the sheets with respect to a direction of a feed of the sheets, the sheets are fed into the operating station, the method comprising at least a second step of detection and variation in which, by means of detection means disposed in correspondence with the feed means, both a position of the sheets with respect to the feed means and also a size of the sheets fed are detected, and operating conditions at least of the feed means are varied in a coordinated manner according to the position and the sizes detected, wherein, depending on the position and the size detected of the sheets, one or more feed members of the feed means, operatively independent with respect to each other, is selectively activated in order to be operatively adjusted to the size and the position of the sheets.

9. The method as in claim 8, wherein in the step of detection and variation, the detection means varies the operating conditions of tools of the operating station in a coordinated manner according to the position and the size of the sheets detected.

10. The method as in claim 8, wherein the material is cardboard.

* * * * *